US006972522B2

(12) United States Patent
Yang

(10) Patent No.: US 6,972,522 B2
(45) Date of Patent: Dec. 6, 2005

(54) MAGNETRON

(75) Inventor: Sung-Chol Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 38 days.

(21) Appl. No.: 10/807,344

(22) Filed: Mar. 24, 2004

(65) Prior Publication Data

US 2005/0012461 A1 Jan. 20, 2005

(30) Foreign Application Priority Data

Jul. 15, 2003 (KR) ..... 10-2003-0048248

(51) Int. Cl.[7] ..... H01J 25/50

(52) U.S. Cl. ..... 315/39.51; 315/39.53; 315/39.71; 313/337; 313/341

(58) Field of Search ..... 315/39.51, 39.53, 315/39.71; 313/337, 341

(56) References Cited

U.S. PATENT DOCUMENTS 4,426,601 A * 1/1984 Tsuzurahara ..... 315/39.51
4,558,250 A * 12/1985 Tsuzurabara ..... 313/337

FOREIGN PATENT DOCUMENTS

JP 60-240026 11/1985

* cited by examiner

*Primary Examiner*—David Vu
(74) *Attorney, Agent, or Firm*—Staas & Halsey LLP

(57) ABSTRACT

A magnetron capable of being efficiently assembled is provided. The magnetron includes a filament, a pair of shields, a pair of leads, a pair of connection plates, and a pair of terminal rods. The filament is coil-shaped. The shields are attached to both ends of the filament, respectively. The leads are attached to the shields at first ends of the leads, respectively. The connection plates are attached to second ends of the leads, respectively. The terminal rods are attached to the connection plates, respectively, to supply power to the leads through the connection plates, and have slender protrusions, which have sectional areas smaller than sectional areas of attachment portions of the terminal rods so that the terminal rods are attached to the connection plates with the slender protrusions passing through the connection plates.

22 Claims, 3 Drawing Sheets

MAGNETRON

CROSS-REFERENCE TO RELATED APPLICATIONS

This application claims the benefit of Korean Patent Application No. 2003-48248, filed on Jul. 15, 2003 in the Korean Intellectual Property Office, the disclosures of which are incorporated herein by reference.

BACKGROUND OF THE INVENTION

1. Field of the Invention

The present invention relates, in general, to magnetrons to generate high-frequency waves, and more particularly, to a magnetron that is capable of being assembled efficiently.

2. Description of the Related Art

In general, a magnetron is a device which generates microwaves in various high-frequency heating apparatuses, such as a microwave oven, to heat food, etc.

A conventional magnetron includes a filament supplied with power to produce thermions, first and second shields mounted on both ends of the filament, respectively, to prevent the thermions from moving toward the ends of the filament, a first lead attached to the first shield and positioned to pass through the filament and the second shield, and a second lead attached to the second shield.

The first and second leads are designed to be supplied with external power through a pair of terminal rods that are connected with an external power source. Connection plates are disposed between the first and second leads and the terminal rods to allow the first and second leads and the terminal rods to be electrically connected to each other, respectively.

In the magnetron, the lengths of the terminal rods must be uniformly maintained to cause the terminal rods to come into contact with external power terminals. Accordingly, the terminal rods must be attached to the connection plates with the lengths of the terminal rods adjusted uniformly, therefore making it difficult to assemble the magnetron.

SUMMARY OF THE INVENTION

Accordingly, it is an aspect of the present invention to provide a magnetron that allows terminal rods to be easily connected to connection plates.

Additional aspects and/or advantages of the invention will be set forth in part in the description which follows and, in part, will be obvious from the description, or may be learned by practice of the invention.

The foregoing and/or other aspects of the present invention are achieved by providing a magnetron, comprising a coil-shaped filament, a pair of shields attached to both ends of the filament, respectively, a pair of leads attached to the pair of shields at first ends of the leads, respectively, a pair of connection plates attached to second ends of the leads, respectively, and a pair of terminal rods attached to the connection plates, respectively, to supply power to the leads through the pair of connection plates, wherein the terminal rods comprises an attachment portion which is attached to each of the connection plates respectively and slender protrusions which have sectional areas smaller than sectional areas of the attachment portions of each of the terminal rods, wherein the pair of terminal rods are attached to the pair of connection plates with the slender protrusions passing through the pair of connection plates.

The slender protrusions and the attachment portions of the terminal rods are circular shaped, and the pair of connection plates are provided with terminal mounting holes having diameters corresponding to diameters of the slender protrusions to allow the slender protrusions to pass therethrough so that the attachment portions of the terminal rods are attached to bottom surfaces of the pair of connection plates and outer surfaces of the slender protrusions of the pair of terminal rods are attached to walls of the terminal mounting holes.

The pair of shields comprising a first shield mounted at a first end of the filament, and a second shield mounted at a second end of the filament, the pair of leads comprising a first lead attached to the first shield and extended through the second shield, and a second lead attached to the second shield, and the pair of connection plates comprising a first connection plate attached to the first lead on a first side of the first connection plate and attached to a first terminal rod on a second side of the first connection plate, and a second connection plate attached to the second lead on a first side of the second connection plate and attached to a second terminal rod on a second side of the second connection plate.

The first and second connection plates are arcuately shaped and provided with terminal mounting holes on first sides of the first and second connection plates, respectively, and are provided with lead mounting holes on second sides of the first and second connection plates, respectively, to allow the leads to be attached thereto.

The first and second terminal rods are attached to the first and second connection plates by a brazing method.

BRIEF DESCRIPTION OF THE DRAWINGS

These and/or other aspects and advantages of the invention will become apparent and more readily appreciated from the following description of the embodiments taken in conjunction with the accompanying drawings in which.

DETAILED DESCRIPTION OF THE PREFERRED EMBODIMENTS

Figure 1:
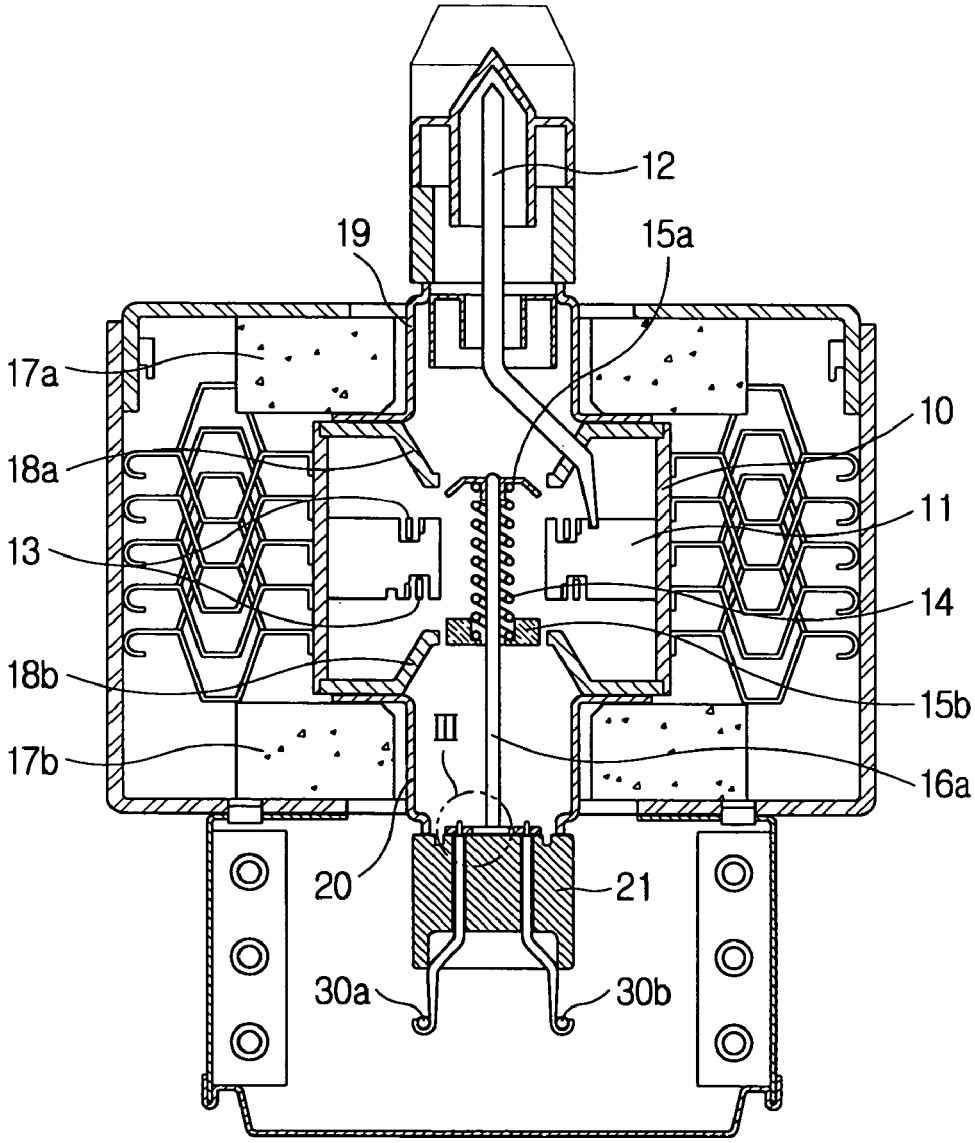
FIG. 1 is a sectional view of a magnetron, according to the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

A magnetron of the present invention, as shown in FIG. 1, comprising an anode having a plurality of vanes 11 and an anode cylinder 10 and radially arranged at regular intervals to form resonant circuits, an antenna 12 connected to one of the vanes 11 to introduce harmonics into an outside of the magnetron, and a plurality of strip rings 13 arranged to alternately connect the vanes 11 to each other at tops and bottoms of the vanes 11, respectively.

A cathode comprising a coil-shaped filament 14 to emit thermions at high temperatures is positioned at a center of the anode cylinder 10. A first shield 15*a* and a second shield 15*b* are attached to ends of the filament 14, respectively. A first lead 16*a* is attached to a center of the first shield 15*a* to pass through a center of the second shield 15*b* and a central portion of the filament 14. A second lead 16*b* is attached to a bottom of the second shield 15*b*. These two leads 16*a* and

16*b* are connected with external power terminals 30*a* and 30*b*, which allows a closed circuit to be formed in the magnetron so as to produce an electric field.

A first permanent magnet 17*a* and a second permanent magnet 17*b* are provided on a top and bottom of the anode, respectively, with opposite magnetic poles of the first and second permanent magnets 17*a* and 17*b* facing each other so as to form a magnetic field across the magnetron. A first pole piece 18*a* and a second pole piece 18*b* are provided to guide magnetic flux generated by the permanent magnets 17*a* and 17*b* toward the filament 14.

A first shield cup 19 and a second shield cup 20 are provided on the first and second pole pieces 18*a* and 18*b* to close openings of the first and second pole pieces 18*a* and 18*b* and maintain vacuum inside the first and second pole pieces 18*a* and 18*b*.

Figure 2:
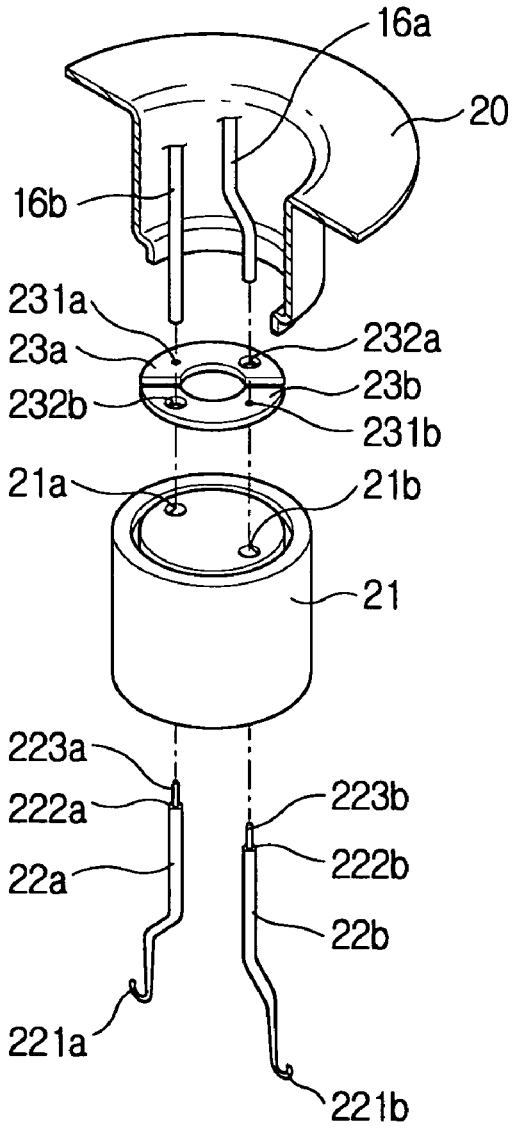
FIG. 2 is a partially exploded perspective view of the magnetron of FIG. 1.

Therefore, the second shield cup 20, as shown in FIG. 2, is open at a bottom thereof to be supplied with power from an outside of the magnetron. An isolation block 21 is positioned to close a lower opening of the second shield cup 20. A pair of terminal rods 22*a* and 22*b* are connected to the external power terminals 30*a* and 30*b* at first ends of the terminal rods 22*a* and 22*b*, respectively, and positioned to pass through the isolation block 21, thus allowing the first and second leads 16*a* and 16*b* to be connected to the terminal rods 22*a* and 22*b*, respectively.

The isolation block 21 is fabricated by shaping insulation material, such as ceramic, into a cylindrical form. The isolation block 21 is tightly attached to the second shield cup 20 to close the opening of the second shield cup 20, and therefore prevent vibrations from leaking through the second shield cup 20. The isolation block 21 is provided with a pair of through holes 21*a* and 21*b* to receive the terminal rods 22*a* and 22*b*, respectively.

The terminal rods 22*a* and 22*b* include a first terminal rod 22*a* attached to the first lead 16*a* and a second terminal rod 22*b* attached to the second lead 16*b*. Each of the terminal rod 22*a* and 22*b* is provided with a connection portion 221*a* and 221*b*, respectively, which are bent in hook forms to be connected to each external power terminals 30*a* and 30*b*, at a first end of the terminal rod 22*a* and 22*b*, respectively. Each of the terminal rods 22*a* and 22*b* is further provided with an attachment portion 222*a* and 222*b* which is attached to each connection plate 23*a* and 23*b*. Slender protrusions 223*a* and 223*b* are protruded from first ends of the attachment portions 222*a* and 222*b* to be more slender than the attachment portions 222*a* and 222*b*, and therefore have sectional areas smaller than those of the attachment portions 222*a* and 222*b*. The attachment portions 222*a* and 222*b* and slender protrusions 223*a* and 223*b* of the terminal rods 22*a* and 22*b* are formed to each have a circular sectional shape so that a diameter of each of the slender protrusions 223*a* and 223*b* is smaller than that of each of the attachment portions 222*a* and 222*b*.

The connection plates 23*a* and 23*b* are formed of metallic plates having arcuate shapes. The connection plates 23*a* and 23*b* are provided with terminal mounting holes 231*a* and 231*b*, which have shapes and areas corresponding to shapes and areas of the slender protrusions 223*a* and 223*b* of the terminal rods 22*a* and 22*b*, respectively, on first sides of the connection plates 23*a* and 23*b*, respectively. The connection plates 23*a* and 23*b* are provided with lead mounting holes 232*a* and 232*b* on second sides of the connection plates 23*a* and 23*b* to allow the leads 16*a* and 16*b* to be attached thereto.

As a result, when the terminal rods 22*a* an 22*b* are inserted into the terminal mounting holes 231*a* and 231*b* of the connection plates 23*a* and 23*b* to attach the terminal rods 22*a* and 22*b* to the connection plates 23*a* and 23*b*, ends of the attachment portions 222*a* and 222*b* of the terminal rods 22*a* and 22*b* are positioned underneath the terminal mounting holes 231*a* and 231*b* and only the slender protrusions 223*a* and 223*b* are inserted into the terminal mounting holes 231*a* an 231*b*, so that lengths of portions of the terminal rods 22*a* and 22*b*, which are protruded from the second shield cup 20, can be uniformly maintained.

Figure 3:
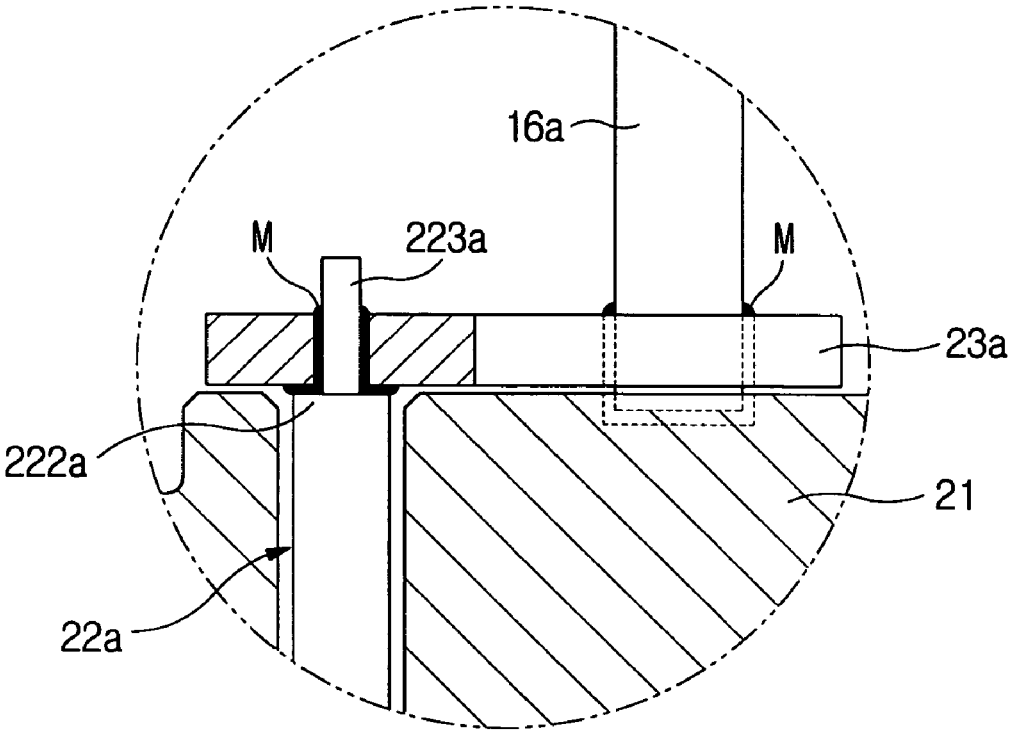
FIG. 3 is an enlarged view of portion III of FIG. 1.

In the present embodiment, the terminal rods 22*a* and 22*b* are attached to the connection plates 23*a* and 23*b* by a brazing method, as illustrated in FIG. 3. In more detail, a molten alloy M is infiltrated into gaps between the terminal rods 22*a* and 22*b* and the connection plates 23*a* and 23*b* according to a capillary phenomenon and solidified in these gaps, thus allowing the terminal rods 22*a* and 22*b* to be attached to the connection plates 23*a* and 23*b*.

Although in the present embodiment, the attachment portions 222*a* and 222*b* and slender protrusions 223*a* and 223*b* of the terminal rods 22*a* and 22*b* have been described as being formed to have circular sections, they are not limited to these but can be formed to have variously shaped sections.

An assembly and operation of the magnetron according to the present invention will be described below.

When the attachment portions 222*a* and 222*b* of the terminal rods 22*a* and 22*b* are inserted into the terminal mounting holes 231*a* and 231*b* of the connection plates 23*a* and 23*b* to attach the terminal rods 22*a* and 22*b* to the connection plates 23*a* and 23*b*, the slender protrusions 223*a* and 223*b* formed to have diameters corresponding to diameters of the terminal mounting holes 231*a* and 231*b* are passed through the terminal mounting holes 231*a* and 231*b*, while the attachment portions 222*a* and 222*b* of the terminal rods 22*a* and 22*b* formed to have diameters larger than the diameters of the slender protrusions 223*a* and 223*b* are caught by the connection plates 23*a* and 23*b* underneath the terminal mounting holes 231*a* and 231*b*. Accordingly, the terminal rods 22*a* and 22*b* are prevented from being deeply inserted into an interior of the second shield 15*b*, so the lengths of the protruded portions of the terminal rods 22*a* ad 22*b* can be uniformly maintained.

When the molten alloy M is applied to the gaps between the connection plates 23*a* and 23*b* and the terminal rods 22*a* and 22*b* after only the slender protrusions 223*a* and 223*b* have been inserted into the terminal mounting holes 231*a* and 231*b*, the molten alloy M is infiltrated into the gaps between outer surfaces of the slender protrusions 223*a* and the 223*b* and walls of the terminal mounting holes 231*a* and 231*b* and between the attachment portions 222*a* and 222*b* and bottom surfaces of the connection plates 23*a* and 23*b*, and the molten alloy M is cooled and solidified, thus attaching the terminal rods 22*a* and 22*b* to the connection plates 23*a* and 23*b*.

As apparent from the above description, the present invention provides a magnetron, in which terminal rods are provided with slender protrusions and only the slender protrusions of the terminal rods are inserted into terminal mounting holes of connection plates, thus uniformly maintaining lengths of portions of the terminal rods that are protruded from a second shield cup.

Furthermore, in the magnetron of the present invention, outer surfaces of the slender protrusions of the terminal rods are not only attached to walls of the terminal mounting holes but attachment portions of the terminal rods are also attached to bottom surfaces of the connection plates, so that the terminal rods are securely attached to the connection plates, thus being capable of reliably preventing vacuum leakage.

Although a few of the present invention have been shown and described, it would be appreciated by those skilled in the art that changes may be made in this embodiment without departing from the principles and spirit of the invention, the scope of which is defined in the claims and their equivalents.

What is claimed is:

1. A magnetron, comprising:

a filament which produces thermions in the magnetron;

a pair of shields attached to ends of the filament which prevent the thermions from moving toward the ends of the filament;

a pair of leads attached to the shields at first ends of the leads, respectively;

a pair of connection plates attached to second ends of the leads, respectively; and a pair of terminal rods attached to the pair of connection plates, respectively, to supply power to the pair of leads through the connection plates wherein the pair of terminal rods comprises:

an attachment portion which is attached to each connection plate respectively, and slender protrusions which have sectional areas smaller than sectional areas of the attachment portions of the terminal rods so that the pair of terminal rods are attached to the pair of connection plates with the slender protrusions passing through the connection plates.

2. The magnetron of claim 1, wherein:

the slender protrusions and the attachment portions of the pair of terminal rods are circular shaped; and the connection plates are provided with terminal mounting holes having diameters corresponding to diameters of the slender protrusions to allow the slender protrusions to pass therethrough so that the attachment portions of the pair of terminal rods are attached to bottom surfaces of the connection plates and outer surfaces of the slender protrusions of the pair of terminal rods are attached to walls of the terminal mounting holes.

3. The magnetron of claim 2, wherein the pair of shields comprising:

a first shield mounted at a first end of the filament, and a second shield mounted at a second end of the filament; and the pair of leads comprising:

a first lead attached to the first shield and extended through the second shield, and a second lead attached to the second shield; and the pair of connection plates comprising:

a first connection plate attached to the first lead on a first side of the first connection plate and attached to a first terminal rod on a second side of the first connection plate, and a second connection plate attached to the second lead on a first side of the second connection plate and attached to a second terminal rod on a second side of the second connection plate.

4. The magnetron of claim 3, wherein the first and second connection plates are arcuately shaped and provided with terminal mounting holes on first sides of the first and second connection plates, respectively, and lead mounting holes on second sides of the connection plates to allow the first and second leads to be attached thereto, respectively.

5. The magnetron of claim 1, wherein the pair of terminal rods are attached to the pair of connection plates by performing a brazing method.

6. A magnetron, comprising:

an anode having a plurality of vanes and an anode cylinder, wherein the plurality of vanes are radially arranged at regular intervals;

an antenna connected to one of the plurality of vanes;

strip rings arranged to alternately connect the plurality of vanes to each other at a top and bottom of the plurality of vanes;

a cathode having a coil-shaped filament to emit thermions at a high temperature and positioned at a center of the anode cylinder;

a first shield and a second shield attached to ends of the coil-shaped filament;

a first lead attached to a center of the first shield to pass through a center of the second shield and a central portion of the filament; and a second lead attached to a bottom of the second shield, wherein the first and second leads are connected with external power terminals which allows a closed circuit to be formed in the magnetron;

a pair of terminal rods having slender protrusions and connected to the external power terminals at first ends of the terminal rods, respectively and positioned to pass through an isolation block to allow the first and second leads to be connected to each of the terminal rods, respectively; and a pair of connection plates attached to ends of the first and second leads, respectively.

7. The magnetron of claim 6, further comprising attachment portions on each of the terminal rods, wherein the attachment portions are attached to bottom surfaces of the pair of connection plates, respectively and the slender protrusions of the terminal rods are attached to terminal mounting holes provided on each of the connection plates, respectively, so that the pair of terminal rods are securely attached to the pair connection plates.

8. The magnetron of claim 6, further comprising a first and a second permanent magnet provided at a top and bottom of the anode, respectively, with opposite magnetic poles of the first and second permanent magnets facing each other so as to form a magnetic field across the magnetron.

9. The magnetron of claim 8, wherein a first pole piece and a second pole piece are provided to guide magnetic flux generated by the first and second permanent magnets toward the filament.

10. The magnetron of claim 9, further comprising a first shield cup and a second shield cup provided on the first and second pole pieces to close openings of the first and second pole pieces and maintain vacuum inside the first and second poles pieces.

11. The magnetron of claim 10, wherein the second shield cup is open at a bottom thereof to be supplied with power from an outside of the magnetron.

12. The magnetron of claim 11, further comprising an isolation block having a pair of through holes to receive the terminal rods and positioned to close a lower opening of the second shield cup.

13. The magnetron of claim 12, wherein the pair terminal rods are connected to the external power terminals at first ends of each of the terminal rods, respectively and positioned to pass through the isolation block allowing the first and second leads to be connected to each of the terminal rods.

14. The magnetron of claim 12, wherein the isolation block is fabricated by shaping insulation material into a cylindrical form.

15. The magnetron of claim 12, wherein the isolation block is tightly attached to the second shield cup to close an opening of the second shield cup and prevent vibrations from leaking through the second shield cup.

16. The magnetron of claim 6, wherein the pair of connection plates are formed of metallic plates having an arcuate shape.

17. The magnetron of claim 6, wherein the pair of connection plates are provided with terminal mounting holes which have shapes and sectional areas corresponding to shapes and sectional areas of the slender protrusions of the pair of terminal rods, and lead mounting holes on second sides of each of the connection plates to allow the first and second leads to be attached thereto.

18. The magnetron of claim 17, wherein the pair of terminal rods are inserted into the terminal mounting holes of each of the connection plates to attach the terminal rods to the connection plates.

19. The magnetron of claim 17, wherein ends of the attachment portions of the terminal rods are positioned underneath the terminal mounting holes and only the slender protrusions of the terminal rods are inserted into the terminal mounting holes, so that the lengths of portions of the terminal rods which are protruding from the second shield cup can be uniformly maintained.

20. The magnetron of claim 19, wherein the attachment portions of the pair of terminal rods are inserted into the terminal mounting holes of the pair of connection plates to attach the terminal rods to the connection plates.

21. The magnetron of claim 19, wherein the slender protrusions are formed to have diameters corresponding to diameters of the terminal mounting holes and pass through the terminal mounting holes, and the attachment portions of the terminal rods are formed to have diameters larger than the diameters of the slender protrusions and are caught by the pair of connection plates underneath the terminal mounting holes to prevent the pair of terminal rods from being inserted into an interior of the second shield so that the lengths of the protruded portions of the terminal rods can be uniformly maintained.

22. The magnetron of claim 19, wherein when the slender protrusions are inserted into the terminal mounting holes, a molten alloy is applied to gaps between the pair of connection plates and the pair of terminal rods to attach the pair of terminal rods to the pair of connection plates.

* * * * *

UNITED STATES PATENT AND TRADEMARK OFFICE

CERTIFICATE OF CORRECTION

PATENT NO. : 6,972,522 B2
APPLICATION NO. : 10/807344
DATED : December 6, 2005
INVENTOR(S) : Sung-Chol Yang It is certified that error appears in the above-identified patent and that said Letters Patent is hereby corrected as shown below:

Column 6, line 39, Claim 7, replace "pair" with --pair of--, therefor;

Signed and Sealed this

Eighteenth Day of July, 2006

JON W. DUDAS
*Director of the United States Patent and Trademark Office*